US007850515B2

(12) United States Patent
Dussault

(10) Patent No.: US 7,850,515 B2
(45) Date of Patent: Dec. 14, 2010

(54) CARD GAME

(75) Inventor: Paul G. Dussault, Barrington, IL (US)

(73) Assignee: GC2, Inc., Arlington Heights, IL (US)

( * ) Notice: Subject to any disclaimer, the term of this patent is extended or adjusted under 35 U.S.C. 154(b) by 809 days.

(21) Appl. No.: 11/758,098

(22) Filed: Jun. 5, 2007

(65) Prior Publication Data

US 2008/0305852 A1 Dec. 11, 2008

(51) Int. Cl.
*A63F 9/24* (2006.01)

(52) U.S. Cl. ..... 463/13; 463/11; 463/25

(58) Field of Classification Search ..... 463/13, 463/11, 25

See application file for complete search history.

(56) References Cited

U.S. PATENT DOCUMENTS 5,704,835 A * 1/1998 Dietz, II ..... 463/20
5,976,016 A * 11/1999 Moody et al. ..... 463/13
6,045,129 A * 4/2000 Cooper et al. ..... 273/292
6,220,959 B1 4/2001 Holmes, Jr. et al.
6,257,979 B1 * 7/2001 Walker et al. ..... 463/13
6,656,044 B1 12/2003 Lewis
7,007,953 B1 3/2006 Cabot
7,118,113 B2 10/2006 Hoyt et al.
7,137,883 B1 11/2006 Falciglia, Sr.
2002/0187823 A1 12/2002 Khal
2005/0170876 A1 8/2005 Masci et al.
2006/0273518 A1 12/2006 Aida
2006/0273519 A1 12/2006 Aida

* cited by examiner

*Primary Examiner*—James S McClellan
*Assistant Examiner*—Lawrence Galka
(74) *Attorney, Agent, or Firm*—Lewis and Roca LLP

(57) ABSTRACT

A card game and video gaming system includes a matrix of card positions in addition to cards dealt for a player's hand. The player may select betting lines or line paths in the matrix to play and set a wager for the selected line paths. Line paths may include a variety of line configurations including rows and/or columns of the matrix. One or more cards may be selected for retention from the player's hand and combined with cards in each of the selected line path of the matrix to form patterns. The matrix may activate card positions or cards depending on line path selections as well as a number of cards selected for retention. A payout may be determined based on the number of patterns formed as well as the type of patterns.

23 Claims, 14 Drawing Sheets

CARD GAME

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Field of the Invention

The invention relates generally to games of chance and video gaming machines. More specifically, the invention provides various methods and systems for a game of chance illustratively embodied in a video gaming machine, whereby the game may be based on one or more patterns in a set of cards.

Background of the Invention

Gaming establishments (e.g., casinos) rely heavily on card games and video gaming devices as a substantial source of income. In regulated gaming jurisdictions, e.g., Las Vegas, Nevada, gaming regulations dictate the minimum levels that a video gaming device must payout, as a percentage of money wagered by players playing the machine, e.g., 90% minimum. Thus, if a machine is said to pay 95%, then the machine pays at least $0.95 in winnings for every $1.00 wagered in the machine. While the profit ratio appears slim, casinos principally rely on the volume of money played for profits. Because each video gaming machine can be considered a relatively fixed cost (maintenance and IP licenses represent minimal ongoing costs), the more money played in each machine, the more a casino's profits.

As the popularity of video card games grows, and as more types of card games are offered in the marketplace, video card game/gaming developers must provide innovative types of card games to maintain a player's interest in a given video gaming machine. Further, in order to maximize profit, casinos are continually seeking new and innovative games to keep players' interest, lest the player wander off into someone else's casino. Thus, there is a continual need in the art to provide new game play methods, bonuses, mini-games, payout methodology, and the like in video gaming devices to maintain player interest.

BRIEF SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

A card game may include a set of cards forming a player's hand and a matrix of cards or card positions set apart from the player's hand. A player may make an initial wager and select rows, columns and/or other betting lines or line paths of the matrix that they wish to play. In one or more configurations, a wager may increase in response to the selection of additional rows, columns and/or betting lines. The player may select a number of cards to keep in his hand while discarding or deactivating the non-selected cards. Once the player has selected the cards he or she wishes to retain, one or more cards or card positions from each row, column or betting line/line path of the matrix of card positions may be activated or placed into play. The number of card positions activated or put in play from each line may be determined based on a number of cards or card positions needed in each row, column and/or betting line of the matrix such that the remaining cards in a player's hand combined with the active card positions in any betting line (e.g., a row or column) of the matrix results in the original number of cards dealt to the player or some other predetermined number (e.g., a five-card poker hand). Cards and card positions may be selected for activation such that each line (e.g., a row, column, diagonal) of a matrix includes the same number of active card positions. If the matrix represents card positions, cards may be dealt into the active card positions and patterns may subsequently be determined based on combinations of the cards retained in the player's hand and the cards dealt to each selected row, column or other line configuration of the matrix. If the matrix is a matrix of cards, the active cards in each selected betting line or line configuration may be revealed.

According to one or more aspects, a payout may be determined based on the number of patterns and/or type of patterns identified from the various combinations of the player's hand and the rows and columns of the matrix. For example, patterns may correspond to poker hands. In one or more configurations, special hands may further be defined in addition to traditional poker hands that provide additional rewards. For example, a hand of jacks over sevens (i.e., a specific full house) may be awarded a bonus reward or payout on top of the standard payout for a full house. Special cards may also be added to a deck (i.e., cards not in a standard 52 card deck) that may also modify a payout or combination of cards. For example, a wild card may be added that allows the player to assign any value and/or suit to that card. In another example, a 3× card may be introduced that triples an award payout of the hand including the 3× card. Alternatively or additionally, a card in a standard 52 card deck may include a 3× or other bonus indicia.

According to one or more additional aspects, a hand may be played against multiple decks of cards or against multiple sets of cards drawn from a single deck. That is, a player may retain his hand (or the cards he has selected to retain from his hand) while betting against multiple matrices of cards. Each matrix may be drawn from a different deck of cards. Alternatively or additionally, if a player does not win with his retained hand, the player may be allowed to use his discarded cards in one or more consolation games. The payout in these consolation games may be decreased.

To overcome limitations in the prior art described above, and to overcome other limitations that will be apparent upon reading and understanding the present specification, aspects of the present invention are directed to a card game and video gaming machine.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1:
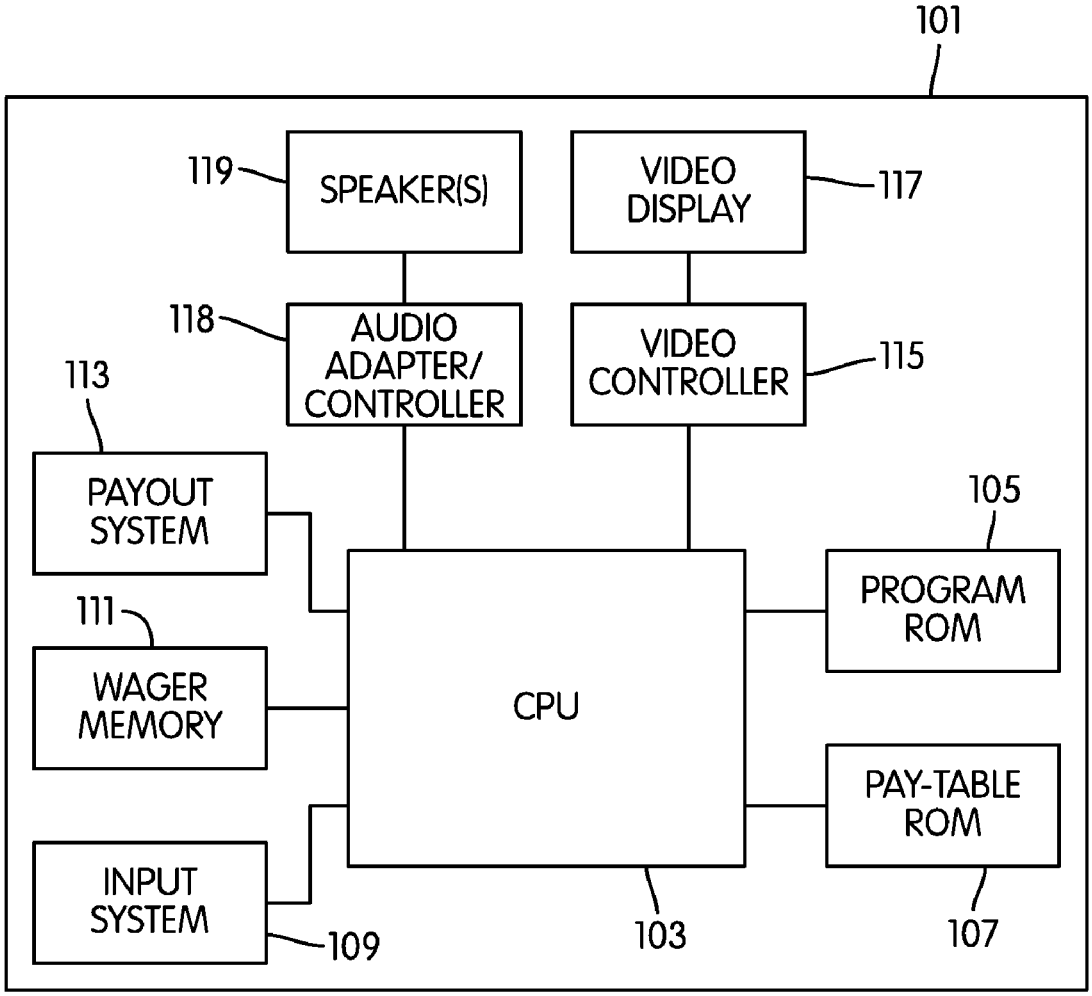
FIG. 1 illustrates an example of a hardware architecture in which one or more aspects of the invention may be embodied.

FIG. 1 provides an example of a hardware architecture in which one or more aspects of the invention may be embodied. Video gaming device 101 may be, in this example, a video slot machine, such as is found in any gaming jurisdiction. Video gaming device may include a CPU 103 controlling overall operation of the video gaming device based on instructions stored in program ROM 105 and pay-table ROM 107. Program ROM 105 stores executable instructions describing the behavior of the video gaming device, to be executed by CPU 103 to control operation of the video gaming device 101. Pay-table ROM 107 stores payout information based on various outcomes of the video gaming device.

CPU 103 may be connected to a video controller 115, which provides visual output to one or more video displays 117. CPU 103 may also provide audio output through one or more speakers 119 via an audio adapter or controller such as audio adapter/controller 118. Audio and video output may vary depending on the specific manner and method in which aspects of the invention are embodied in video gaming device 101, as will be appreciated upon reading further details below and with reference to the additional figures.

Input system 109 may include one or more buttons, toggles, switches, levers, coin/token slots, paper money/ticket receivers, magnetic card reader, touch-sensitive display screen(s) and the like, through which a player can deposit money into the video gaming device 101, review help and instructional information, select wager amounts, select pay lines, start a game, make selections during a game (e.g., in a bonus round), decide to cash out, etc. Wager memory 111 stores a current amount of money deposited by the player into the video gaming device 101, and may also store current wager information input by the player, e.g., number of lines played, bet per line, etc. Payout system 113 may include a coin/token dispenser, paper money/ticket dispenser, or any other device through which a user can withdraw money from video gaming device 101.

Video gaming device 101 is illustrative only. As used herein, the term "video gaming device" may refer to any data processing device, whether a computer, video slot machine, mechanical slot machine, mobile telephone, personal digital assistant, MP3 player, and the like, on which a game of chance performing as described herein may be stored, implemented, and/or executed. For example, one or more aspects of the invention may be embodied in computer-usable data and computer-executable instructions, such as in one or more program modules, executed by one or more computers or other devices. Generally, program modules include routines, programs, objects, components, data structures, etc. that perform particular tasks or implement particular abstract data types when executed by a processor in a computer or other device. The computer executable instructions may be stored on a computer readable medium such as a hard disk, optical disk, removable storage media, solid state memory, ROM, RAM, etc. As will be appreciated by one of skill in the art, the functionality of the program modules may be combined or distributed as desired in various embodiments. In addition, the functionality may be embodied in whole or in part in firmware or hardware equivalents such as integrated circuits, field programmable gate arrays (FPGA), and the like. Particular data structures may be used to more effectively implement one or more aspects of the invention, and such data structures are contemplated within the scope of computer executable instructions and computer-usable data described herein.

In many gaming institutions and organizations, electronic or computerized card games are often very popular. Accordingly, a video gaming device such as device 101 of FIG. 1 may be used to provide a computerized card game such as poker. Cards may be displayed on the one or more video displays 117 of FIG. 1 and users may interact with the displayed cards through the input system 109. In one or more configurations, input system 109 may include a touch-sensitive video display of video displays 117. Thus, a user may, for example, select and de-select cards to hold in a game of poker by touching the screen in a location corresponding to the cards. CPU 103 may further be configured to determine one or more patterns (e.g., poker hands) resulting from one or more combinations of cards as well as a payout or prize associated with the one or more combinations of cards. CPU 103 may make the aforementioned determinations using pay-table ROM 107 and/or program ROM 105.

Figure 2:
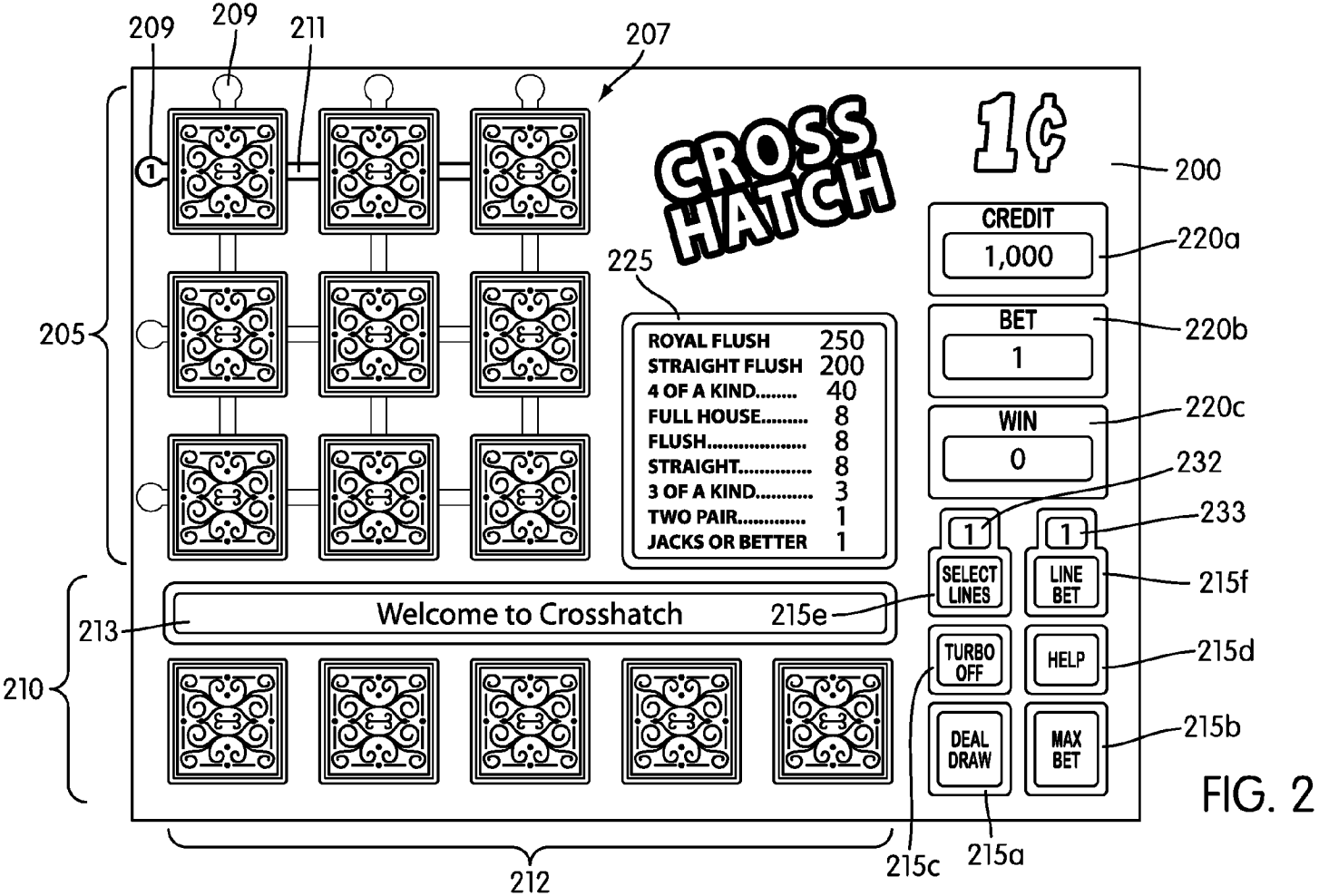
FIG. 2 illustrates a game interface in which a matrix of cards is used in combination with a player's hand to determine an outcome according to one or more aspects described herein.

FIG. 2 illustrates a computerized poker game user interface according to one or more aspects described herein. User interface 200 may be, for example, an interface displayed on a video gaming device such as video gaming device 101 of FIG. 1. Interface 200 may include card matrix display area 205, card hand display area 210, options 215, wager boxes 220 and pay-table information area 225. Card matrix display area 205 may display a square matrix of N card positions, e.g., like matrix 207. Cards dealt in those N positions may be used in combination with one or more cards in player's hand 212 to form one or more patterns that may result in various rewards. Card matrix display area 205 may further include one or more row/column markers 209 that allow a player to identify selected rows and/or columns. Markers 209 may change appearance if a player selects a corresponding row or column. For example, if a row is selected, the corresponding marker may change the appearance of line 211 that runs through the background of the selected row. Markers 209 may further include an indication of a wager associated with the corresponding row or column. Alternatively or additionally, other indicators (not shown) may be displayed to identify selected rows, columns and/or other line paths or configurations.

Card hand display area 210 may be configured to display player's hand 212. Player's hand 212 may initially be displayed face down (i.e., in a position where the card value and suit are hidden) and revealed upon selecting an option such as deal draw option 215*a*. Further, in one or more arrangements, card hand display area 210 may include hold options (not shown) under each card. A player may use hold options to select the card(s) he or she wishes to retain or hold in his or her hand. Card hand display area 210 may further include information bar 213 that displays one or more instructions for the player. For example, information bar 213 may display "Please hold two or more cards" to aid the player. In addition, pay-table information area 225 may be used to display payouts for different types of card patterns. In a game of poker, for example, pay-table information area 225 may display the payouts for each type of poker hand. This information may aid the player in determining an amount to wager and/or a strategy. In addition, pay-table information area 225 may be automatically updated in response to an increase or decrease in the bet or wager.

Wager boxes 220 may include balance information box 220*a*, wager box 220*b* and win box 220*c*. Balance information box 220*a* may indicate the amount of credits or value available for the player to use. Wager box 220*b*, on the other hand, may indicate a current wager for the current hand. Wager box 220*b* may be additive so that multiple wagers for the same hand may be added to provide a total wager. Win box 220*c* may be configured to display the payout or reward value once an outcome of the game has been determined. Alternatively or additionally, win box 220*c* may be used to display a total amount won over the course of multiple hands (e.g., a player's session).

In addition to deal draw option 215*a*, options 215 may include max bet option 215*b*, turbo option 215*c*, help option 215*d*, select lines option 215*e* and line bet option 215*f* Max bet option 215*b* may be used to automatically place the maximum bet allowed at a given time. In one or more arrangements, selecting max bet option 215*b* may also cause all lines to be selected. Line bet option 215*f*, on the other hand, may be used to indicate a bet for each individual line that a player selects for play. Line bet display area 233 may display a current per line bet. In one or more arrangements, a player may modify the per line bet by selecting line bet option 215*f* and/or entering a value directly into line bet display area 233. Further, a player may select lines to play using select lines option 215*e*. The number of lines currently selected may be displayed in lines selected display area 232. A player may modify the number of lines selected by selecting or de-selecting lines, inputting a value directly into display area 232 and/or using select lines option 215*e* to increase or decrease the number of lines selected.

Turbo option 215*c* may be used to speed up gameplay. For example, animations such as card dealing and reward counting (e.g., counting up the reward amount) may be sped up or eliminated altogether. If the player requires help or instructions on the game, the player may select help option 215*d* to access an information screen containing additional instructions or answers to frequently asked questions.

The foregoing elements of user interface 200 may be configured in a variety of arrangements. Further, additional or alternative options and display elements may be used in interface 200.

Figure 3:
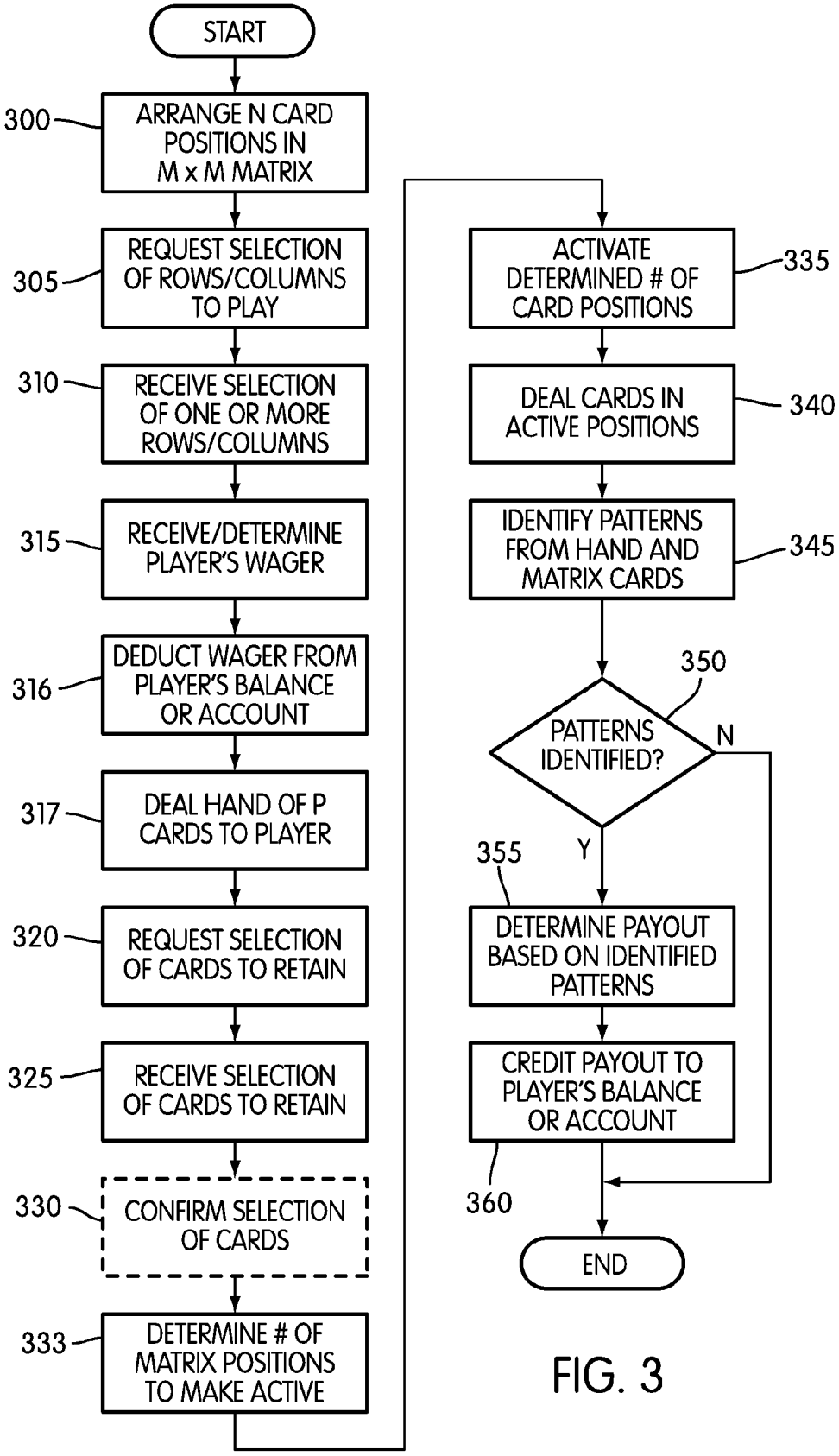
FIG. 3 is a flowchart illustrating a method for determining an outcome of a card game using a matrix of cards according to one or more aspects described herein.

FIG. 3 is a flowchart illustrating a method for determining a value associated with a combination of two or more cards in a card game. In step 300, a grid of N card positions may be displayed in an M×M matrix. That is, the N card positions may be configured in a square matrix formation. Thus, if there are nine total card positions, the matrix may be configured as a 3×3 matrix (e.g., matrix 207 of FIG. 2). Alternatively, if there are 16 card positions, the grid may be represented as a 4×4 matrix. Each position of the matrix may be represented by a place holder card in a face down position or by some other marker. A face down position, as used herein, generally refers to cards placed with their value and suit hidden from a player's view (e.g., facing downward if the game is played on a horizontal surface). The number of card positions N may be determined based on card game rules and/or preferences.

In step 305, the player may be asked to select one or more rows and/or columns of the card matrix to play. In response, in step 310, one or more row and/or column selections may be received. In step 315, a wager may be received or otherwise determined for each selected row or column. In one example, a wager may be entered using line bet option 215*f* which may set the same wager for each selected row and/or column. Alternatively, different wagers may be entered for each of the selected row and/or columns or, alternatively, the same wager may be used for each row and/or column. Further, in one or more configurations, a player may be allowed to enter a first wager for all columns and a second wager for all rows. A variety of wagering schemes may be used to allow a player to use various wagering strategies and preferences. Further, a wager may be required prior to dealing the player's hand.

Figure 4:
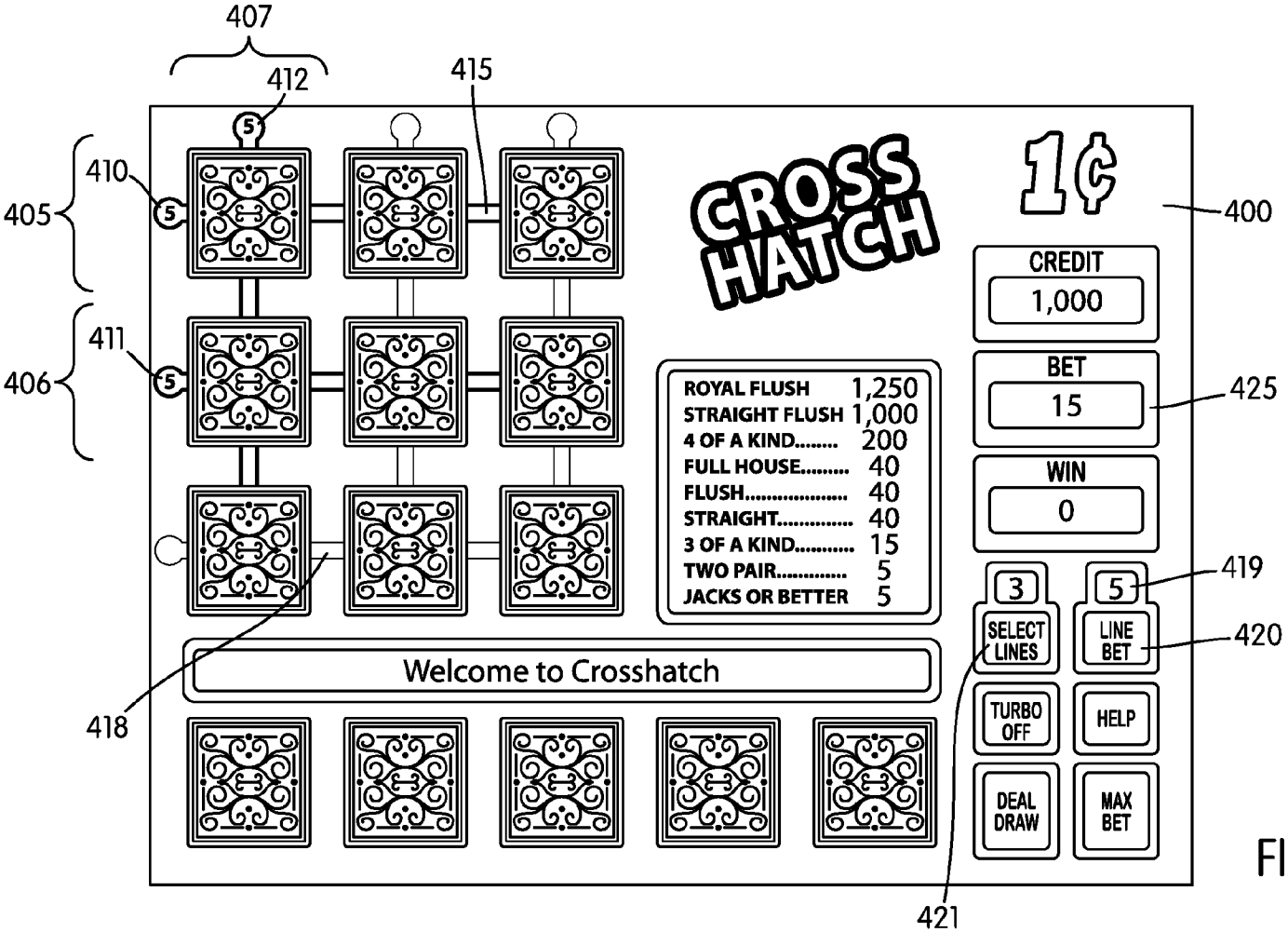
FIG. 4 illustrates a card game interface in which various rows and columns have been selected for play according to one or more aspects described herein.

FIG. 4 illustrates a card game interface in which rows 405 and 406 and column 407 have been selected. Interface 400 may identify selected rows 405 and 406 and column 407 using one or more indicators 410-412. In one example, interface 400 may specify which rows and/or columns have been selected by coloring a line such as line 415 running through the background of the selected row or column of cards, e.g., row 405. Lines running through the background of non-selected rows and/or columns, e.g., line 418, may be a default color such as gray. In another example, the selected rows may further be identified by a label such as "H1" for a first row selected, "H2" for a second row selected and/or "V1" for a first column selected. Additionally or alternatively, the card positions in the selected rows 405 and 406 and column 407 may be displayed differently than the non-selected cards. For example, card positions in selected rows 405 and 406 may include a highlighted outline and/or may be displayed more brightly than the non-selected card positions. Rows and columns may be selected in a variety of ways including by using select lines option 421 or by choosing the marker, e.g., markers 410, 411 and 412 corresponding to the desired row or column. For example, if a player wishes to select column 407, he or she may select marker 412 to activate that column.

Similarly, if a player wishes to select row 406, he or she may select marker 411 to activate that row.

Line wagers may be entered using bet option 420 and displayed in line wager box 419. A total wager, e.g., line wager × number of lines, may be displayed in wager box 425. The wager associated with each selected row and column 405, 406 and 407, may be displayed in corresponding markers 410, 411 and 412, respectively. As bet option 420 is selected, the bet may be increased or decreased and the values in box 419 and/or markers 410, 411 and 412 may increase or decrease in accordance therewith. A variety of wagering methods and systems may be used.

Referring again to FIG. 3, once the wager and selection of rows and/or columns have been confirmed, the wager may be deducted from the player's balance or account in step 316. A player may then be dealt a hand of P cards in step 317. In one example, the cards may be dealt in response to a player selecting a deal draw option such as option 215*a* of FIG. 2. The number P of cards that are dealt may be defined based on the rules of the card game and/or preferences of the player. For example, seven cards may be dealt if the game is seven card draw while five cards may be dealt if the game is five card draw. In step 320, the player may be asked to select one or more cards of the hand of P cards he or she wishes to keep. In step 325, the player's selection of one or more cards to retain is received. Restrictions may be placed on the number of cards a player may or is required to keep. For example, a player may be restricted to retaining a minimum of two cards of out of the initially dealt five cards. The retention minimum may be determined or defined based on the number of card positions in each column and row of the matrix, or by some other predetermined criteria (e.g., a proprietor's preference). According to one or more arrangements, a player may be required to keep P-M cards. That is, the minimum number of cards retained in a player's hand combined with the number of card positions M in a row or column of the matrix may be required to add up to the original number of cards (i.e., P) in the player's hand. A maximum number of cards that may be retained may also be defined, e.g., a player may retain all P cards, P-1 cards, etc. Alternatively or additionally, a player may select cards which he or she wishes to discard in addition to or in place of selecting cards to hold.

Figure 5:
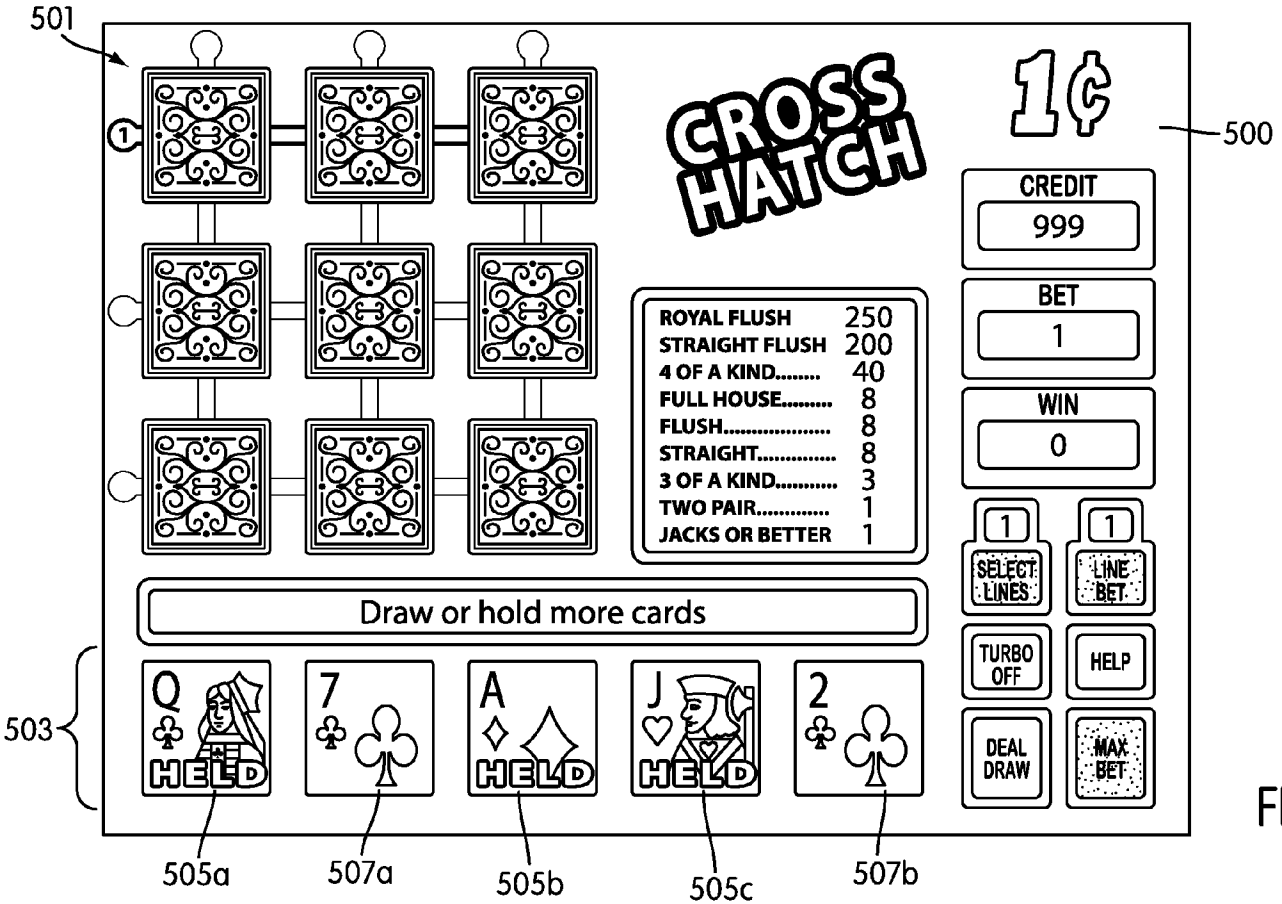
FIG. 5 illustrates a card game interface in which a number of cards have been selected for retention from an original hand according to one or more aspects described herein.

FIG. 5 illustrates a user interface with three cards selected for retention in a hand of five cards. Because card matrix 501 is a three by three matrix (i.e., M=3), the minimum number of cards that may be required for retention in player's original hand 503 of five cards may be two cards. Upon selection, selected cards 505 may be displayed or configured differently than non-selected cards 507. For example, the word "HELD" may appear on the bottom of each of selected cards 505. Alternatively or additionally, selected cards 505 may be raised or displayed more brightly than the non-selected cards. Further, the draw deal button may be grayed out or may be kept inactive until the required minimum number of cards is selected for retention. In addition, an error message may be displayed in the field of play (not shown). Still further, a counter may be displayed in the interface that identifies the number of cards that must still be selected before reaching the required minimum for retention.

Referring again to FIG. 3, in step 330, confirmation of the selected cards may optionally be requested. For example, player may be asked to lock in the selected cards that will be retained in the player's hand by selecting a confirmation option. Confirmation may additionally or alternatively result from the player making an additional wager.

In step 333, a number of card positions to make active or put in play from each row or column of the matrix may be determined. The number of card positions made active or put in play from each selected row or column may be determined based on the number of cards selected for retention. In one or more configurations, activating a card position may correspond to designating the position for card dealing. In other words, cards are dealt into active or in-play positions while cards might not be dealt into inactive positions. According to one or more aspects, card positions may be selected for activation such that each row and each column include a number of cards, or card positions, that, in combination with the number of retained hand cards equal the original number of cards in a player's hand. For example, if a player is initially dealt a hand of five cards and chooses to retain three cards, two card positions from each row or column of the matrix may be activated. Accordingly, in step 335, the determined number of cards may be activated from each row or column of the matrix. Card positions may be selected for activation in a manner such that each row or column of the matrix includes the same number of cards. Thus, in the previous example, two card positions from each row or column of the matrix may be selected for activation such that each row and column may include only two card positions. Once card positions have been placed into play, cards may be dealt into the active card positions in step 340.

In one or more configurations, dealt cards that are not in a selected row or column may appear differently than cards in selected rows or columns. The difference in appearance may provide an indication that those cards are not in play or are inactive. For example, a dealt card that is neither in a selected row nor in a selected column may appear grayed out or dimmed to reflect that the card will not be used in determining a final outcome of the game.

Figure 6:
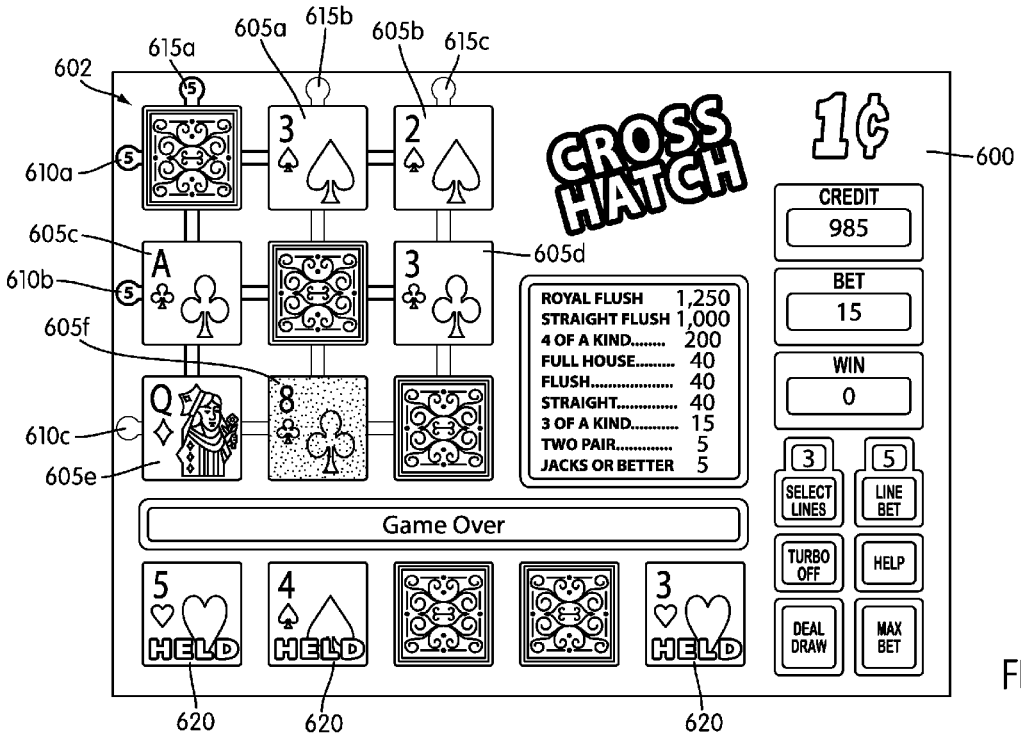
FIG. 6 illustrates another card game interface in which cards have been dealt to active card positions in a matrix according to one or more aspects described herein.

FIG. 6 illustrates card game interface 600 in which cards have been dealt into active card positions 605 of matrix 602. As illustrated, card positions are selected for activation such that each row 610 and each column 615 include a number of cards, or card positions, that, in combination with the number of retained hand cards 620, equal the original number of cards in a player's hand. In particular, since the player selected to retain three cards in his or her original hand of five cards, matrix 602 activates two cards or card positions in each row and column so that the three retained cards combined with cards in any selected row or column results in a combination of five cards. Further, a card dealt into card position 605*f* may have a different appearance (e.g., grayed out) than other dealt cards since card position 605*f* is neither in a selected row nor in a selected column (e.g., rows 610*a* and 610*b* and column 615*a*). This different appearance may indicate to a player that those cards are not determinative of a final outcome.

Figure 7:
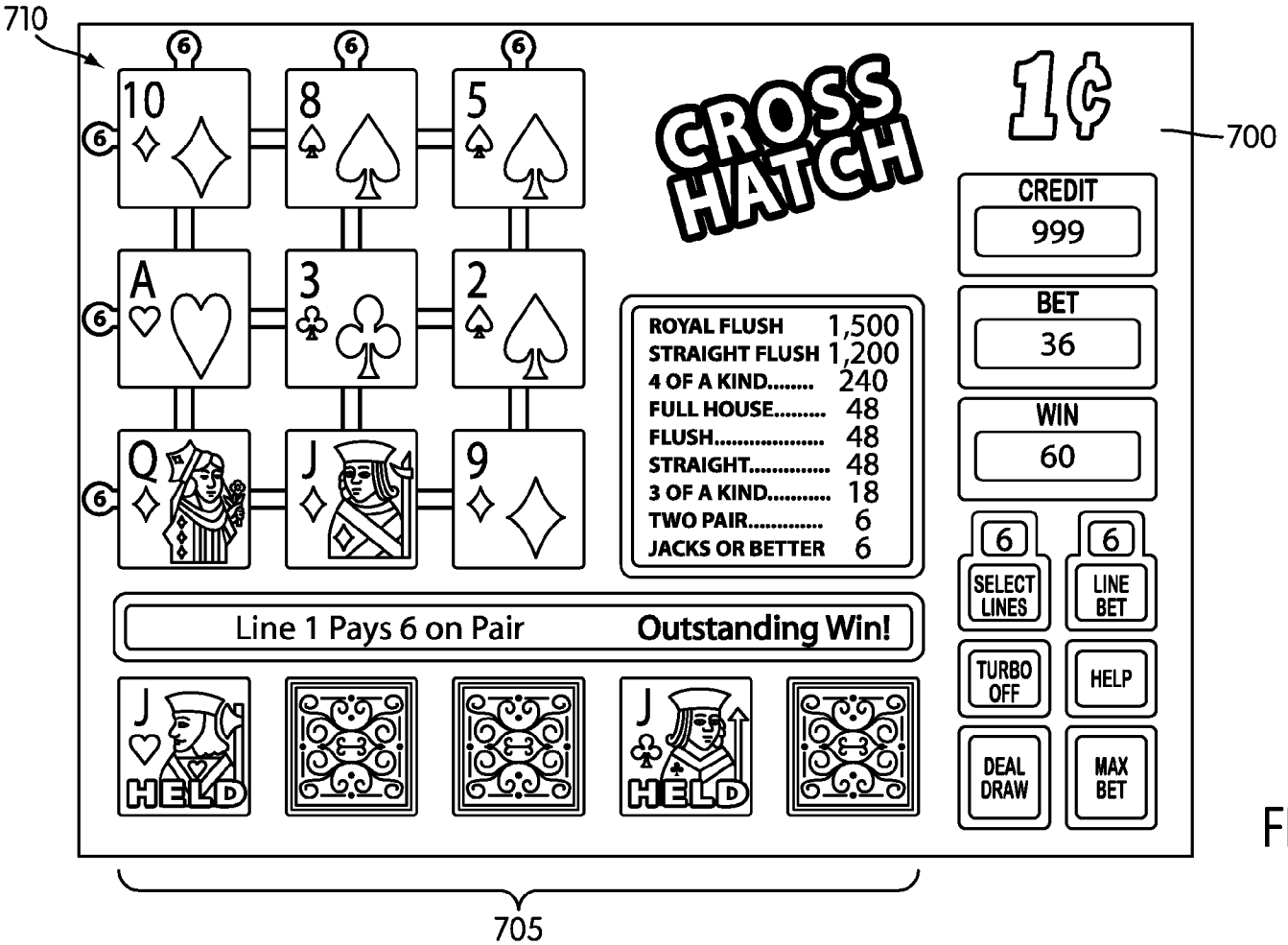
FIG. 7 illustrates another card game interface in which two cards are retained in a player's hand and in which three cards are dealt/revealed in each line of a matrix according to one or more aspects described herein.

FIG. 7 illustrates card game interface 700 in which two cards are retained in player hand 705 and all card positions are put in play in 3×3 matrix 710. In addition, all rows and columns have been selected and as such, there are no inactive cards or card positions.

Figure 8:
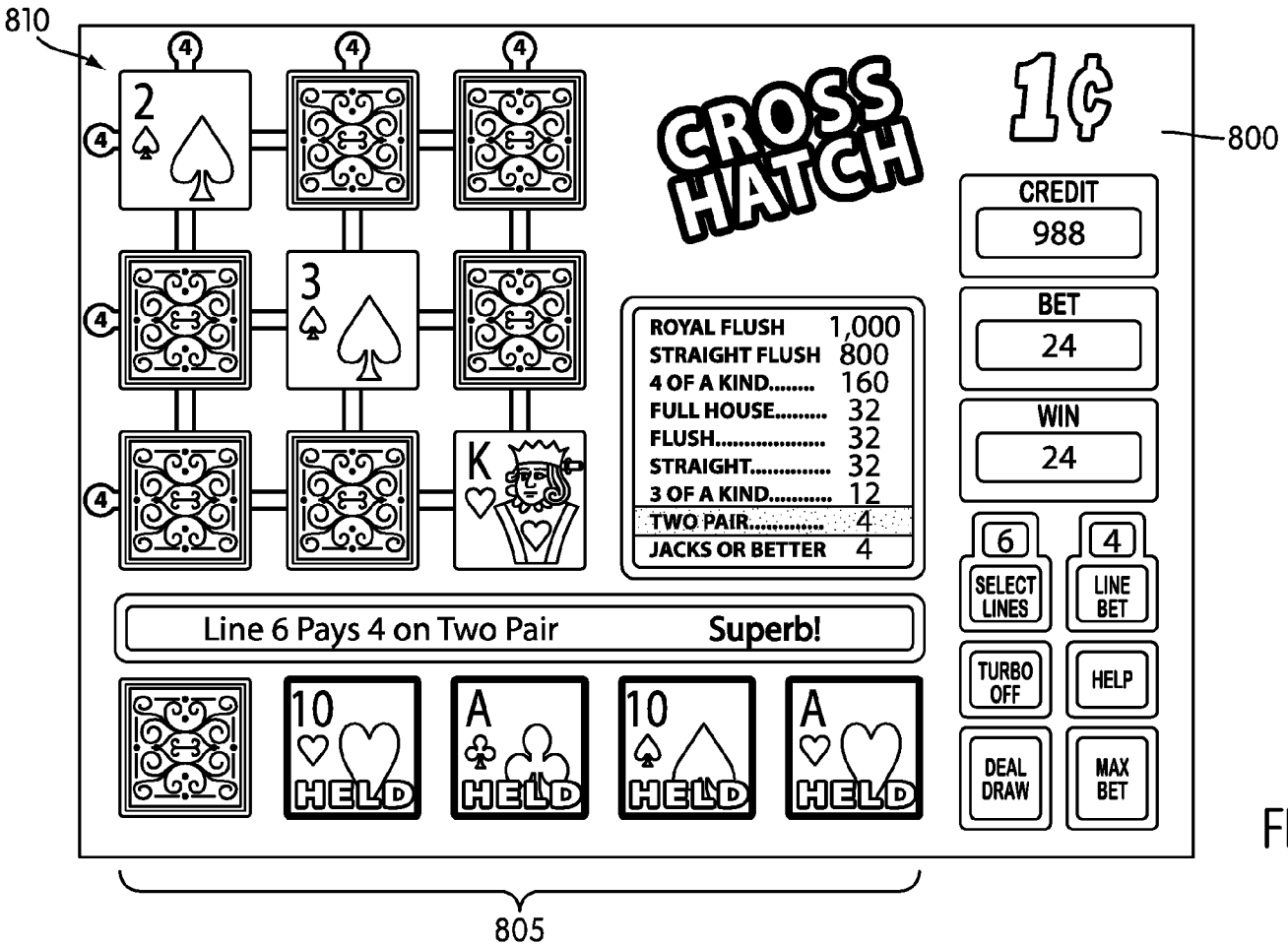
FIG. 8 illustrates another card game interface in which four cards are retained in a player's hand and in which one card per line is dealt/revealed in a matrix according to one or more aspects described herein.

FIG. 8 illustrates card game interface 800 in which four cards are retained in player hand 805 and in which one card position is kept in play in each row and column of matrix 810. Since all rows and columns are selected, no inactive positions or cards are shown.

Referring again to FIG. 3, in step 345, zero or more patterns may be identified from the player's remaining hand in combination with the cards in each selected row and/or column in the modified matrix. That is, a first pattern may be identified from a player's remaining hand in combination with the cards in a first selected row while a second pattern may be identified from a player's hand in combination with the cards of a second selected row. The patterns may be identified based on predefined rules. In a poker card game, for example, card patterns may include one pair, two pair, three of a kind, straight, flush, full house, four of a kind, straight flush, royal flush, and the like. In step 350, a determination may be made as to whether any patterns were identified from step 345.

If, however, one or more patterns are identified, a determination of a payout or other value may be made based on the identified patterns in step 355, e.g., based on a comparison to pay-table ROM 107. In one or more configurations, different payout amounts or other values may be assigned to different types of patterns. For example, three of a kind may pay 3-to-1 while a straight may pay 8-to-1. Bonuses may also be assigned for particular card patterns. In one example, four of a kind kings may provide a bonus on top of the payout normally associated with a four of a kind hand. The values or payouts for each type of card pattern may be defined based on the odds of such a pattern and/or various rules and preferences. In step 360, the determined payout amount or value may be credited to the player's balance or account. The player may then choose to play again or may end the game.

Figure 9:
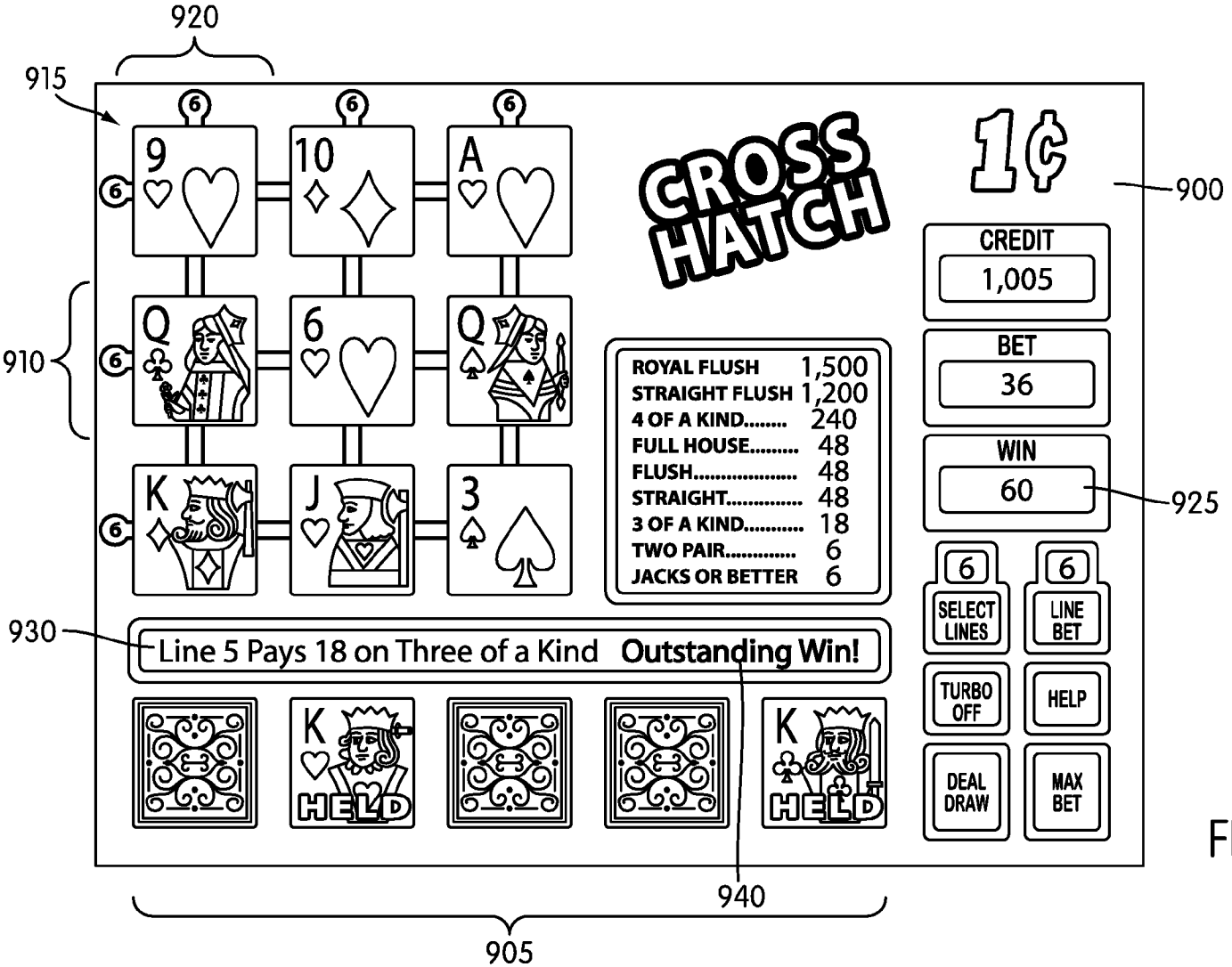
FIG. 9 illustrates another card game interface in which one or more patterns are identified and a payout is determined in accordance with one or more aspects described herein.

FIG. 9 illustrates a card game interface in which retained hand cards 905 combined with second row 910 of matrix 915 produces a pair of queens and a pair of kings while retained hand cards 905 combined with first column 920 produces a three of a kind (i.e., three kings). Payout information 925 may indicate a total amount of credits or value awarded. Additionally, information bar 930 may display the credits or reward for each selected row and/or column as well as one or more messages, e.g., congratulatory message 940.

Figure 10:
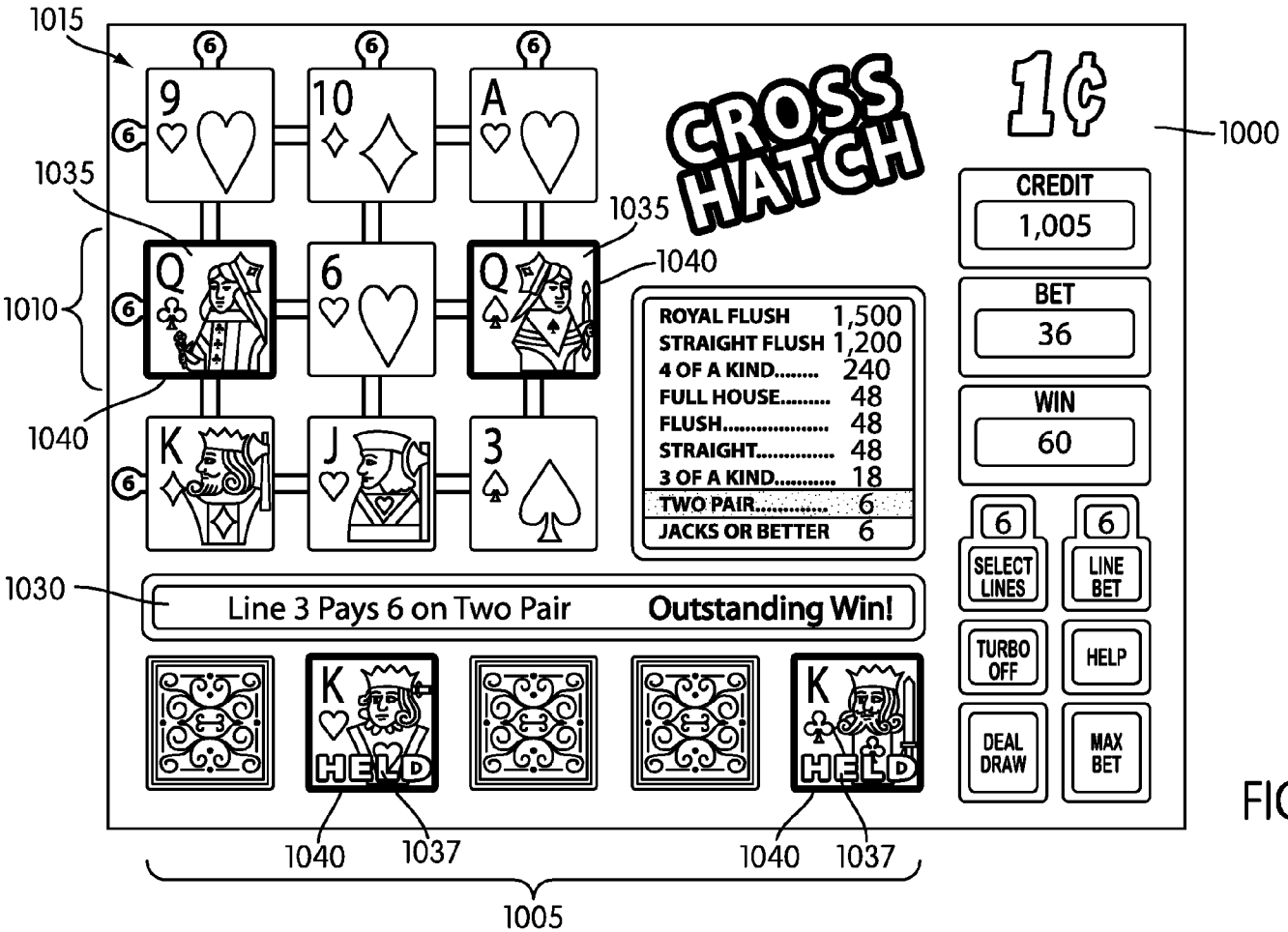
FIG. 10 illustrates another card game interface in which cards associated with an identified pattern include an indicator according to one or more aspects described herein.

In one or more arrangements, a card game interface such as interface 1000 of FIG. 10 may highlight the cards making up the winning pattern. For example, second row 1010 of matrix 1015 combined with player's hand 1005 produces two pairs (i.e., a pair of queens and a pair of kings). As such, interface 1000 may display a visual cue, e.g., outline 1040, corresponding to each of cards 1035 and 1037 to identify the two pairs. Further, information bar 1030 may show the payout of the card pattern currently being identified.

Figure 11:
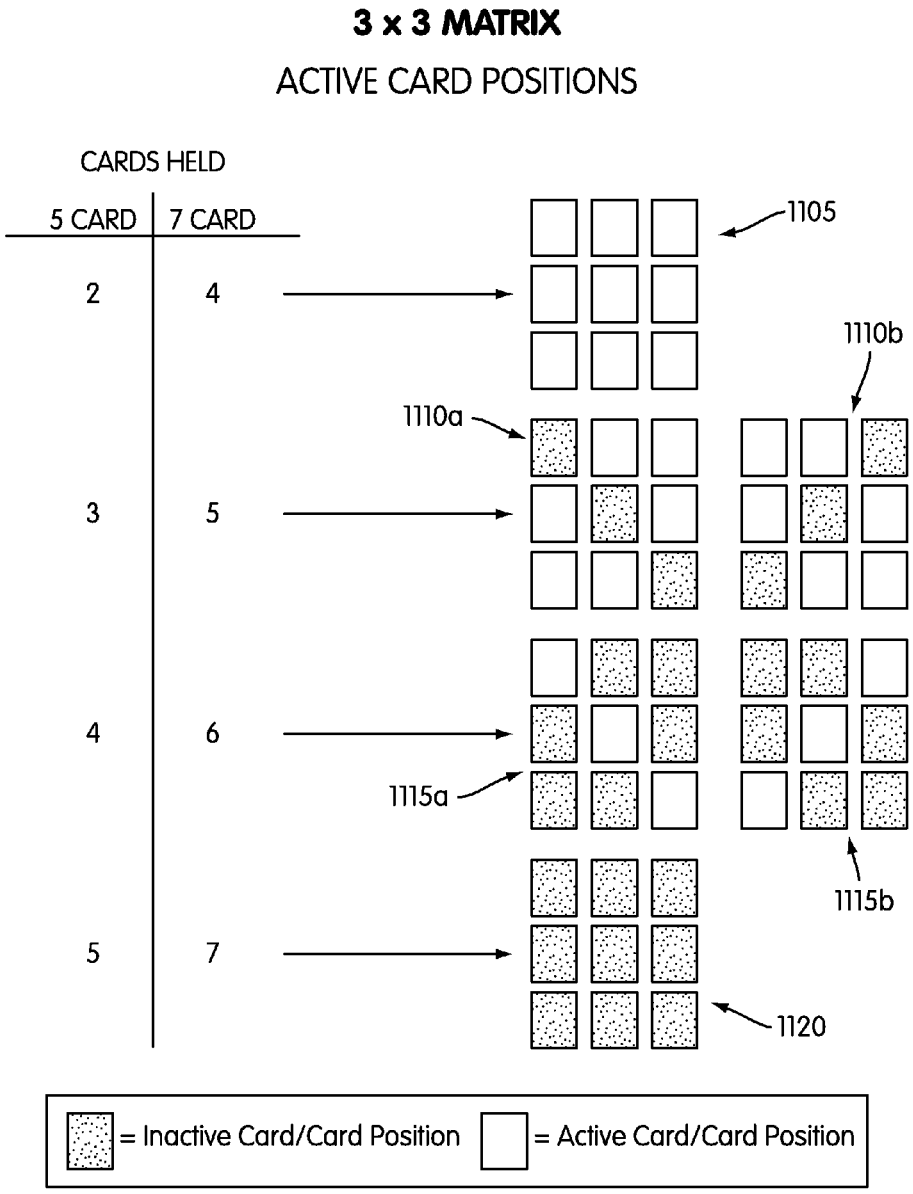
FIG. 11 illustrates a table of 3×3 card matrix configurations, wherein each matrix configuration corresponds to a number of cards held by a player according to one or more aspects described herein.

FIG. 11 illustrates a table showing different numbers of cards that may be held in both 5 and 7 card games as well as corresponding active card positions in a card matrix. According to the illustrative embodiments of FIG. 11, the number of card positions activated and/or the number of cards dealt may depend on the number of cards held by the player. In a first scenario, a player may hold 2 cards in a 5 card poker game or 4 cards in a seven card poker game. Corresponding 3×3 matrix 1105 would include 9 active card positions (or dealt cards) so that the number of cards in each row and column combined with the number of cards held results in the number of cards in the player's original hand (i.e., 5 or 7). In a second scenario, a player may hold 3 cards in a 5 card game and 5 cards in a seven card game. Accordingly, 3×3 card matrix configurations 1110*a* and 1110*b* may each include 6 active card positions or cards in the illustrated patterns where each row and column includes 2 active cards or card positions. Other configurations that include 6 active card positions or cards where each row, column or line include 2 active cards or card positions may also be generated.

In yet another scenario, a player may hold 4 cards in a 5 card game and 6 cards in a seven card game. In such an instance, each of matrix 1115*a* and matrix 1115*b* might include only 1 active card position or 1 dealt card per row and column. If a player chooses to hold all of their cards in either the 5 or 7 card games, matrix 1120 might not include any dealt cards in any of the card positions (i.e., all card positions are inactive).

Figure 12:
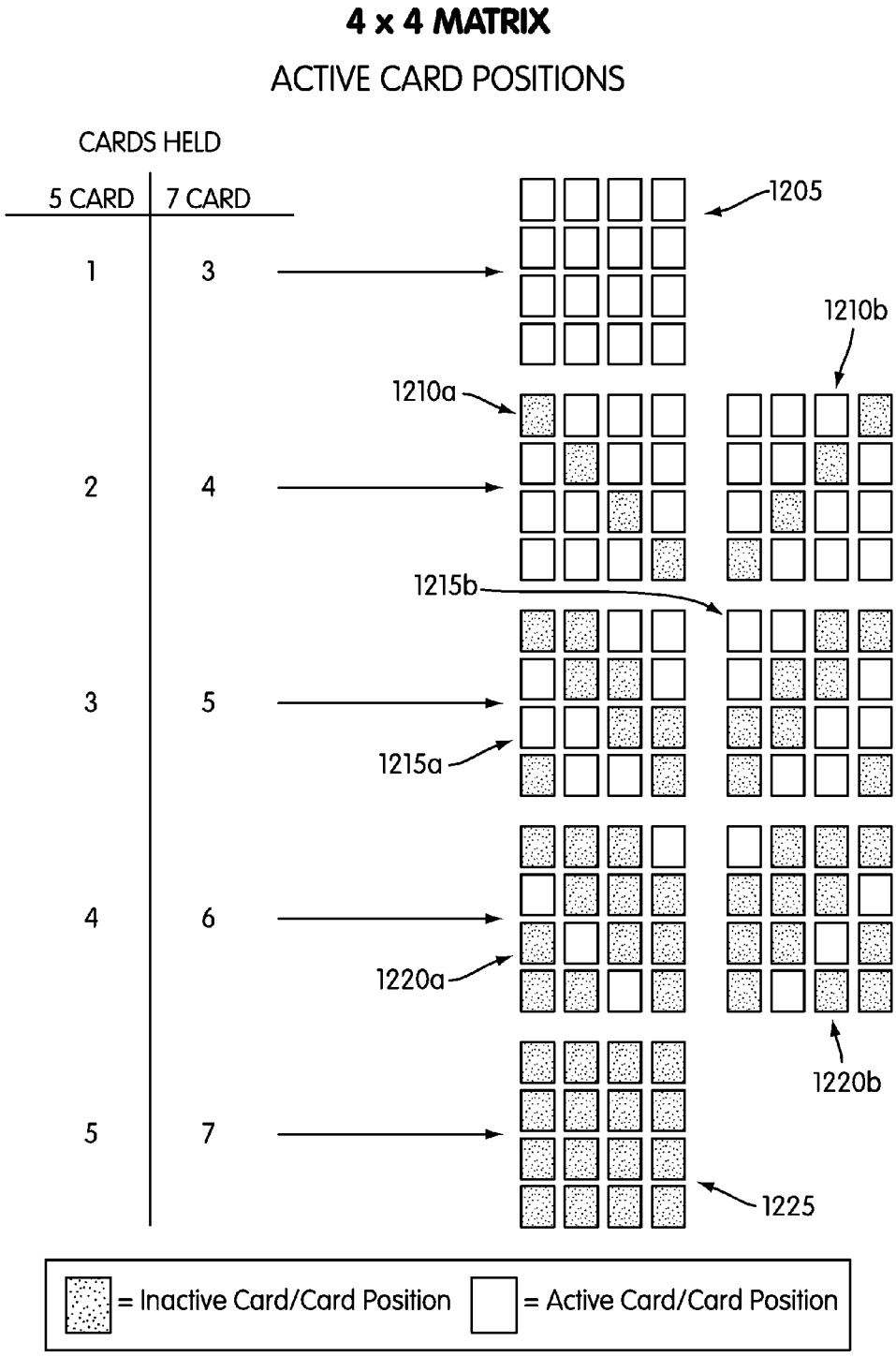
FIG. 12 illustrates a table of 4×4 card matrix configurations, wherein each matrix configuration corresponds to a number of cards held by a player according to one or more aspects described herein.

FIG. 12 illustrates a table showing different numbers of cards that may be held in 5 and 7 card games and corresponding 4×4 matrix configurations showing active and/or inactive card positions. In contrast to a game having a 3×3 matrix (as illustrated in FIG. 11), 5 or 7 card games using a 4×4 matrix may require a player to hold only 1 or 3 cards, respectively. The corresponding matrix, matrix 1205 may deal all 16 cards so that the number of cards in the player's hand in addition to the number of cards in each row and column add up to the original number of cards dealt to the player (i.e., 5 or 7). In another example, if a player holds 2 cards in a 5 card game, either corresponding matrix configuration 1210*a* or 1210*b* may be used. Other matrix configurations may also be used provided that each of the configurations includes the same number of cards in each row, column or other predefined betting line or line path (e.g., a zigzag or a diagonal). Other matrix configurations 1215, 1220 and 1225 may correspond to a player holding 3, 4 and 5 cards, respectively, in a 5 card game or 5, 6 and 7 cards, respectively, in a 7 card game.

Figure 13:
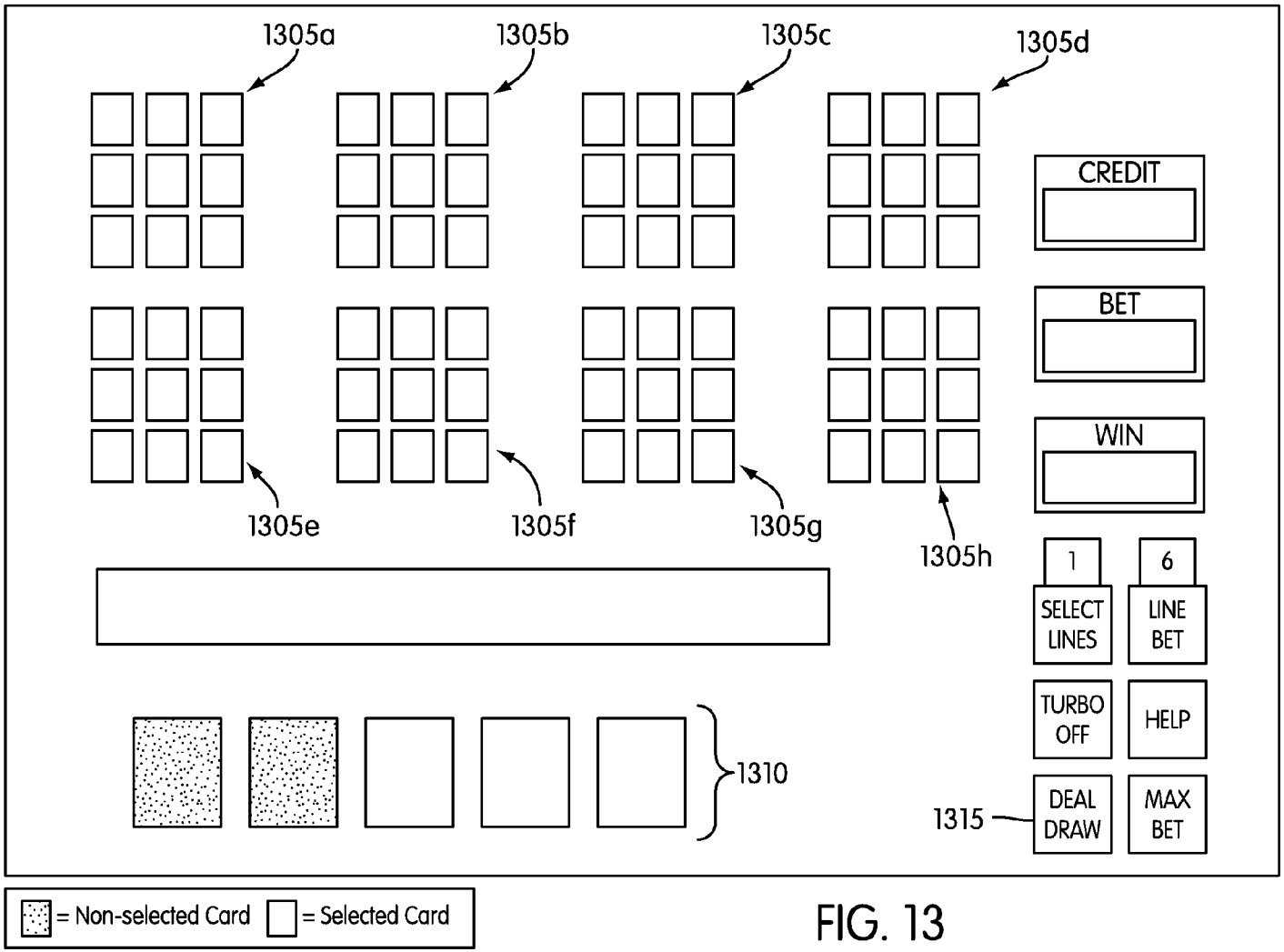
FIG. 13 illustrates a multi-deck card game arrangement according to one or more aspects described herein.

In one or more arrangements, e.g., as illustrated in FIG. 13, multiple decks 1305 may be used to allow a player to play the same retained hand cards 1310 against multiple decks of cards dealt into matrices 1305. Thus, when a player selects deal draw option 1315 after selecting cards to hold in his or her hand, cards may be dealt to all matrices 1305. Alternatively, each time a player selects deal draw option 1315, cards may be dealt into an additional matrix. That is, a player may select deal draw option 1315 for the first time, triggering cards to be dealt into matrix 1305*a*. The next or second time the player selects deal draw option 1315, cards may be dealt into matrix 1305*b*. Further, the cards dealt into matrices 1305*a* and 1305*b* may originate from different card decks. This provides the player with multiple chances to form card patterns and achieve various patterns. Each deck or matrix that the player wishes to use may require another wager or payment. Alternatively, rather than having multiple matrices 1305 showing, cards may be dealt into the same matrix (e.g., matrix 1305*a*) by replacing the previously dealt cards. According to one or more further aspects, a player may use the same retained hand cards, e.g., held cards 1310, with multiple matrices dealt from a single deck, rather than from multiple decks.

Furthermore, cards not retained in a player's hand may be used in a consolation side game. For example, cards discarded from a player's hand may be combined with the selected rows and/or columns of the matrix to determine whether patterns exist. The payout for the consolation game may be lower than that of the non-consolation game.

Figure 14:
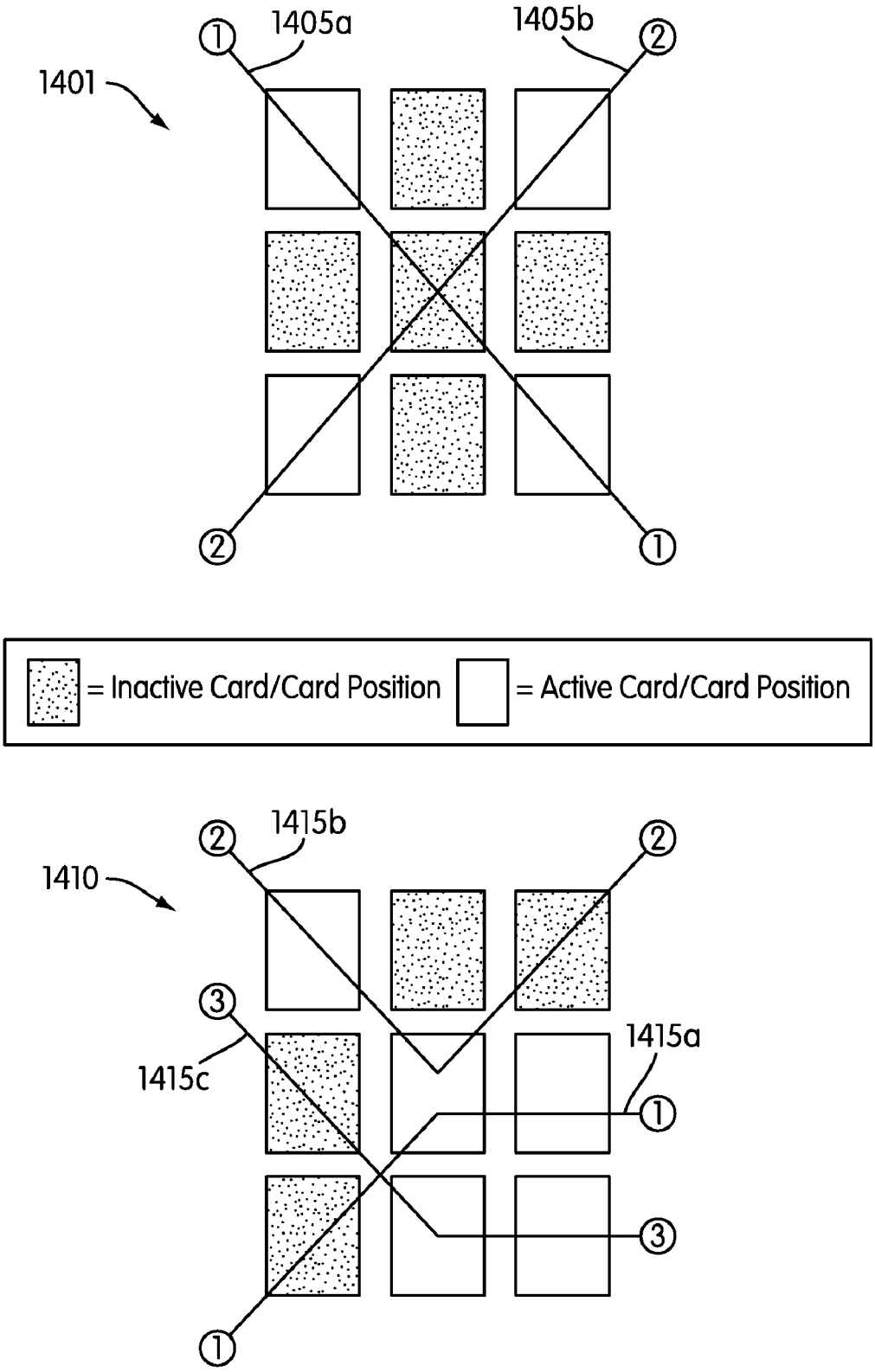
FIG. 14 illustrates various line configurations that may be defined for a card matrix according to one or more aspects described herein.

While many of the features and aspects described herein relate to choosing a row or column of cards for play, other types of line configurations may be defined and selected in accordance with aspects described herein. FIG. 14, for example, illustrates multiple line paths or betting lines that may be defined and selected. In card matrix 1401, for example, two diagonals of cards 1405*a* and 1405*b* are defined as selectable line paths. Accordingly, a player may choose to bet on one or both of diagonals 1405*a* and 1405*b*. In card matrix 1410, a variety of other line paths or betting lines 1415*a*, 1415*b* and 1415*c* are illustrated. Cards and/or card positions may be selected for activation as discussed above e.g., in reference to FIG. 3. That is, card positions may be selected for play or activation such that each betting line or line path includes the same number of active card positions or cards. For example, in matrix 1401, each of diagonals 1405*a* and 1405*b* include two cards when a player chooses to hold 3 cards in a 5 card poker game. Similarly, in matrix 1410, active positions may be selected as indicated by the grayed card/ card positions if a player chooses to hold 3 cards in a 5 card game or 5 cards in a 7 card game (i.e., such that each line 1415 includes only 2 active card positions). In one or more arrangements, a line path in a 3×3 matrix such as matrix 1410 may pass through or include more than 3 cards, allowing a player more or less cards in his or her hand.

Further, aspects of the card game described herein may allow a user to automatically hold a best hand. However, in doing so, the payout percentage may be lowered. Additionally or alternatively, non-standard cards may be added to the deck to increase or otherwise modify the payouts and/or patterns available in the game. For example, a bonus or 2× card may be introduced into a deck. Having a bonus or 2× card may increase the payout for an identified pattern by a corresponding amount (e.g., double if the player has the 2× card). A bonus may be provided as a unique card or as indicia on a card of a standard 52 card deck.

Aspects of the card game described herein relate to dealing cards into a matrix after a row and/or column have been selected and cards have been selected for retention in a player's hand. However, in one or more embodiments, cards may be dealt into the matrix prior to the aforementioned steps. The cards may be dealt in a hidden or face-down position such that the value and suit of the cards are not revealed. Cards in the matrix may then be put into play (i.e., made active) based on the number of cards retained in the player's hand. The active cards may then be revealed (i.e., value and suit revealed to a player) to determine an outcome of the game. A variety of card dealing methods and protocols may be used.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. An apparatus comprising:

a processor; and a memory for storing computer readable instructions that, when executed by said processor, cause the apparatus to perform a method comprising:

arranging N card positions in an M×M matrix, where M>2, the M×M matrix including at least one row line path and one column line path;

dealing a first set of P cards;

receiving a player selection of zero or more cards to retain from the first set of P cards;

determining a number of card positions to make active from each of the at least one row line path and one column line path of the M×M matrix based on a number of cards selected from the first set of P cards;

activating the determined number of card positions from each row of the M×M matrix such that the determined number of card positions activated in each row and column of the M×M matrix is equal to P minus the number of selected cards to retain;

dealing a second set of cards into one or more of the N card positions of the M×M matrix identifying zero or more card patterns formed by one or more first combinations of the selected cards of the first set of P cards and the second set of cards dealt into the M×M matrix; and outputting a value associated with the identified zero or more card patterns.

2. The apparatus of claim 1, wherein the second set of cards is only dealt into the active card positions.

3. The apparatus of claim 1, wherein identifying the zero or more card patterns includes:

determining whether the selected cards of the first set of P cards combined individually with any of the at least one line path of dealt cards in the M×M matrix matches one or more predefined patterns.

4. The apparatus of claim 3, wherein the one or more predefined patterns comprise poker hands.

5. The apparatus of claim 1, wherein P is five and wherein M is three.

6. The apparatus of claim 1, wherein the outputted value is determined based on at least one of: a number of card patterns and zero or more pattern types of the identified zero or more card patterns.

7. The apparatus of claim 1, wherein the memory further comprises instructions for receiving a player selection of one or more line paths of the at least one line path of the m×M matrix.

8. The apparatus of claim 7, wherein the zero or more patterns are only identified from cards dealt in the active card positions of the one or more selected line paths of the M×M matrix.

9. The apparatus of claim 1, wherein the at least one line path includes a row or column of the M×M matrix.

10. The apparatus of claim 1, wherein the memory further comprises instructions for:

dealing a third set of cards into the one or more of the N card positions of the M×M matrix by replacing the second set of cards; and identifying zero or more second card patterns formed by one or more second combinations of the one or more selected cards of the first set of P cards and the third set of cards.

11. The apparatus of claim 10, wherein the third set of cards and the second set of cards are dealt from a single deck of cards.

12. The apparatus of claim 10, wherein the third set of cards is dealt from a first deck of cards and the second set of cards is dealt from a second deck of cards.

13. One or more computer readable media storing computer readable instructions that, when executed by a processor, cause the processor to perform a method comprising:

arranging N card positions in an M×M matrix, where M>2, the M×M matrix including at least one row path and one column path;

dealing a first set of P cards;

receiving a player selection of zero or more cards to retain from the first set of P cards;

determining a number of card positions to make active from each of the at least one row path and one column path of the M×M matrix based on a number of cards selected from the first set of P cards;

activating the determined number of cards from each row of the M×M matrix such that the determined number of card positions activated in each row and column of the M×M matrix is equal to P minus the number of selected cards to retain;

dealing a second set of cards into one or more of the N card positions of the M×M matrix;

identifying zero or more card patterns formed by one or more first combinations of the selected cards of the first set of P cards and the second set of cards dealt into the M×M matrix; and outputting a value associated with the identified zero or more card patterns.

14. The one or more computer readable media of claim 13, wherein the second set of cards is only dealt into the active card positions.

15. The one or more computer readable media of claim 13, wherein identifying the one or more card patterns includes:

determining whether the selected cards of the first set of P cards combined individually with any column and any row of dealt cards in the M×M matrix matches one or more predefined patterns.

16. The one or more computer readable media of claim 13, wherein the one or more predefined patterns comprise poker hands.

17. The one or more computer readable media of claim 13, wherein P is five and wherein M is three.

18. The one or more computer readable media of claim 13, wherein the outputted value is determined based on at least one of: a number of card patterns and zero or more pattern types of the identified zero or more card patterns.

19. The one or more computer readable media of claim 13, further comprising instructions for receiving a selection of one or more line paths of the at least one line path of the M×M matrix.

20. The one or more computer readable media of claim 19, wherein the zero or more patterns are only identified from cards dealt in active card positions of the one or more selected line paths of the M×M matrix.

21. The one or more computer readable media of claim 13, further comprising instructions for:

dealing a third set of cards into the one or more of the N card positions of the M×M matrix by replacing the dealt second set of cards; and identifying zero or more second card patterns formed by one or more second combinations of the one or more selected cards of the first set of P cards and the third set of cards.

22. The one or more computer readable media of claim 13, wherein the at least one line path includes a row or column of the M×M matrix.

23. A gaming system comprising:

a display screen;

a processor; and a memory for storing computer readable instructions that, when executed by the processor, cause the gaming system to perform a method comprising:

displaying a M×M matrix of N card positions in a first portion of the display screen, where M=3 and N=9;

receiving a selection of one or more betting lines, wherein each betting line corresponds to a unique row or column of the M×M matrix;

identifying a wager associated with each selected betting line;

displaying a first set of P cards in a second portion of the display screen, wherein P=5 and the first set of P cards represents a player's hand;

receiving a selection of cards to retain from the first set of P cards, wherein the selection identifies two or more cards to retain;

activating a determined number of card positions from each row of the M×M matrix such that the determined number of card positions activated in each row and column of the M×M matrix is equal to P minus the number of selected cards to retain;

dealing a second set of cards in one or more active card positions of each row and column of the M×M matrix; and identifying zero or more card patterns formed by individually combining each selected betting line with the two or more selected cards of the first set of P cards; and outputting a value associated with the identified zero or more card patterns, wherein the value is determined based on the wager received.

* * * * *